United States Patent [19]

Heine, Jr. et al.

[11] Patent Number: 4,502,669

[45] Date of Patent: Mar. 5, 1985

[54] INSIDE-OUTSIDE TUBE QUENCHING APPARATUS

[75] Inventors: Christian H. Heine, Jr., Longview; Robert W. McGaw, Irving; W. Edwin Wetzel, Jr., Daingerfield, all of Tex.; Joseph Ziegler, Apollo, Pa.

[73] Assignee: Lone Star Steel Company, Dallas, Tex.

[21] Appl. No.: 522,530

[22] Filed: Aug. 12, 1983

Related U.S. Application Data

[62] Division of Ser. No. 352,945, Feb. 26, 1982, Pat. No. 4,417,928.

[51] Int. Cl.[3] ..... C21D 1/62

[52] U.S. Cl. ..... 266/114; 266/259; 134/152; 134/170

[58] Field of Search ..... 266/114, 117, 134, 259; 148/128, 143, 144, 148, 153; 134/133, 152, 170, DIG. 2

[56] References Cited

U.S. PATENT DOCUMENTS

| | | | |
|---|---|---|---|
| 3,252,695 | 5/1966 | Kuchera | 266/130 |
| 3,278,349 | 10/1966 | Huseby et al. | 148/144 |
| 3,294,597 | 12/1966 | Kuchera | 148/143 |
| 3,294,599 | 12/1966 | Huseby | 148/143 |
| 3,682,721 | 8/1972 | Seulen et al. | 148/144 |
| 3,682,722 | 8/1972 | Winstrom | 148/143 |
| 3,915,763 | 10/1975 | Jennings et al. | 148/143 |
| 4,123,301 | 10/1978 | Pope et al. | 148/153 |
| 4,226,645 | 10/1980 | Waid et al. | 148/143 |

*Primary Examiner*—L. Dewayne Rutledge
*Assistant Examiner*—Robert L. McDowell
*Attorney, Agent, or Firm*—Donald E. Degling

[57] ABSTRACT

An apparatus and method is provided simultaneously to quench a tubular on the inside and outside surfaces during horizontal axial movement of the heated tubular into the apparatus. The apparatus comprises a generally cylindrical frame carrying two external and internal quench heads mounted 180° apart on the cylindrical frame. The cylindrical frame is mounted for oscillatory motion about the axis of the frame through an angle of 180°. A first heated tubular is delivered to the apparatus for simultaneous inside and outside quenching while the cylindrical frame is in a first position. Thereafter, the cylindrical frame and the first tubular is oscillated through 180° to the second position where the first tubular may be withdrawn from the apparatus. In its second position, the second inside and outside quenching heads are in registry with the heating furnace so that a second tubular may be quenched while the first tubular is being withdrawn from the apparatus. Thereafter, the cylindrical frame and the second quenched tubular are oscillated back to the first position where the first inside and outside quenching heads are in registry with the furnace and the second quenched tubular can be withdrawn. The apparatus and method provide substantially continuous quenching of tubulars in a relatively compact apparatus having a delivery on one side only of the heating furnace.

7 Claims, 12 Drawing Figures

INSIDE-OUTSIDE TUBE QUENCHING APPARATUS

This is a division of application Ser. No. 352,945, filed Feb. 26, 1982, U.S. Pat. No. 4,417,928.

BACKGROUND OF THE INVENTION

1. Field of the Invention

The present invention relates to a method and apparatus for quenching tubulars and, more particularly, to a method and apparatus for simultaneously quenching the inside and outside surfaces of tubulars.

2. Prior Art

In order to produce the desired metallurgical properties in tubular goods, it is necessary to provide heat treatments which may include rapid quenching from elevated temperatures to below the lower critical temperature. Such quenching may be provided in various ways, including water spraying on the external surface of the tubular, water spraying on the internal surface of the tubular, dipping the tubular vertically into a quenching bath, simultaneous water spraying on both the external and internal surfaces of the tubular, or dipping the tubular laterally into a quenching bath.

Kuchera U.S. Pat. No. 3,252,695 discloses an apparatus for quenching channel members in which the channel is held in a horizontal position by movable die sections and quenched on its inside and outside surfaces along its length. The method of quenching is set forth in the contemporaneous Kuchera U.S. Pat. No. 3,294,597.

Winston U.S. Pat. No. 3,682,722 describes a method of quenching tubulars by suspending the tubular in a tower, heating the tubular and then lowering it into a pit between rotating inside and outside quenching heads.

Huseby U.S. Pat. No. 3,294,599 describes a method and apparatus by which tubulars are simultaneously quenched on the inside and the outside by passing the heated tubular in a horizontal direction between inside and outside quenching heads. The tubular is first heated in a horizontal furnace and then passed in a horizontal direction over one of two inside quenching heads mounted on quenching mandrels having a length sufficient to accommodate the length of the tubular. The outer quenching head is then indexed horizontally toward the furnace to clear the tubular, and the inside quenching assembly is then moved laterally so as to register the second inside quenching head with the horizontal furnace and outside quenching head thereby permitting the quenching of a second tubular while the first quenched tubular is removed from the apparatus. Huseby also discloses an alternative apparatus wherein a single outside and inside quenching assembly is mounted to swing in a horizontal plane to permit removal of the quenched tubular from the quenching mandrel.

Pope et al. U.S. Pat. No. 4,123,301 discloses another method and apparatus for providing simultaneous inside and outside quenching of tubulars. Pope discloses a fixed outside quenching head and an axially movable mandrel upon which is mounted an inside quenching head. The heated tubular is first passed over the inside quenching head when that head is in registry with the outside quenching head. Thereafter, the mandrel and inside quenching head are moved axially to clear the tubular and the tubular is transferred laterally to a conveyor leading either to a tempering furnace or across a cooling bed to a delivery conveyor. The mandrel and inside cooling head are then returned axially to the initial position to receive another heated tubular.

SUMMARY OF THE INVENTION

In accordance with the present invention, an apparatus and method is provided simultaneously to quench a tubular on the inside and outside surfaces during horizontal axial movement of the heated tubular into the apparatus. The apparatus comprises a generally cylindrical frame carrying two external and internal quench heads mounted 180° apart on the cylindrical frame. The cylindrical frame is mounted for oscillatory motion about the axis of the frame through an angle of 180°. In accordance with the invention, a first heated tubular is delivered to the apparatus for simultaneous inside and outside quenching while the cylindrical frame is in a first position. Thereafter, the cylindrical frame and the first tubular is oscillated through 180° to the second position where the first tubular may be withdrawn from the apparatus. In its second position, the second inside and outside quenching heads are in registry with the heating furnace so that a second tubular may be quenched while the first tubular is being withdrawn from the apparatus. Thereafter, the cylindrical frame and the second quenched tubular are oscillated back to the first position where the first inside and outside quenching heads are in registry with the furnace and the second quenched tubular can be withdrawn. The apparatus and method of the present invention provide substantially continuous quenching of tubulars in a relatively compact apparatus having a delivery on one side only of the heating furnace.

Further objects and advantages of the present invention will become apparent in the following detailed description taken in conjunction with the drawings in which.

Figure 1:
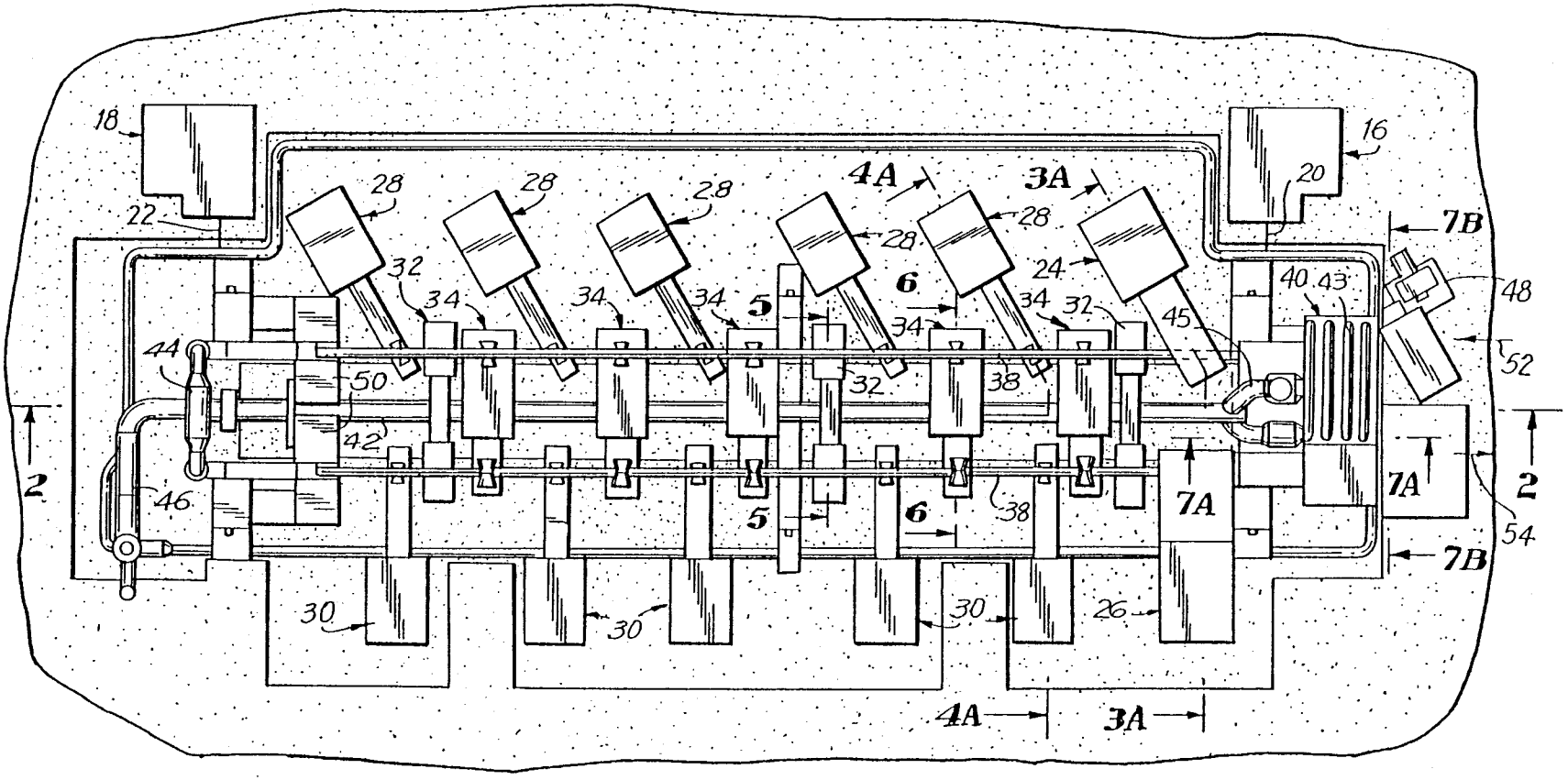
FIG. 1 is a diagrammatic top plan view of apparatus in accordance with the present invention wherein the tubular is quenched while moving into the apparatus in a direction from the right end of the drawing and removed from the apparatus in a direction toward the right end of the drawing.
Figure 7A:
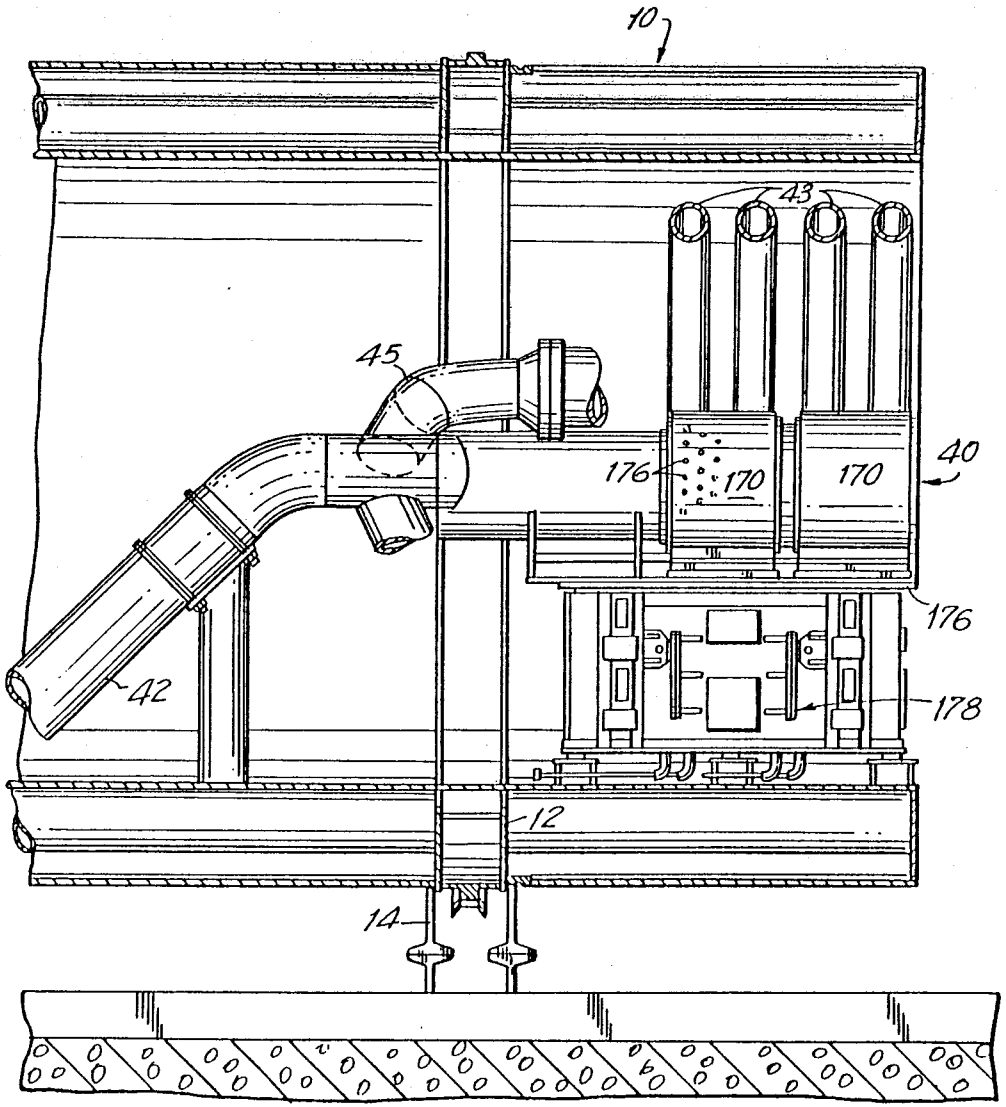

FIG. 7*a* is an enlarged elevational view taken along lines 7A—7A of FIG. 1 showing, in more detail, the outside quenching head assemblies.

Figure 7B:
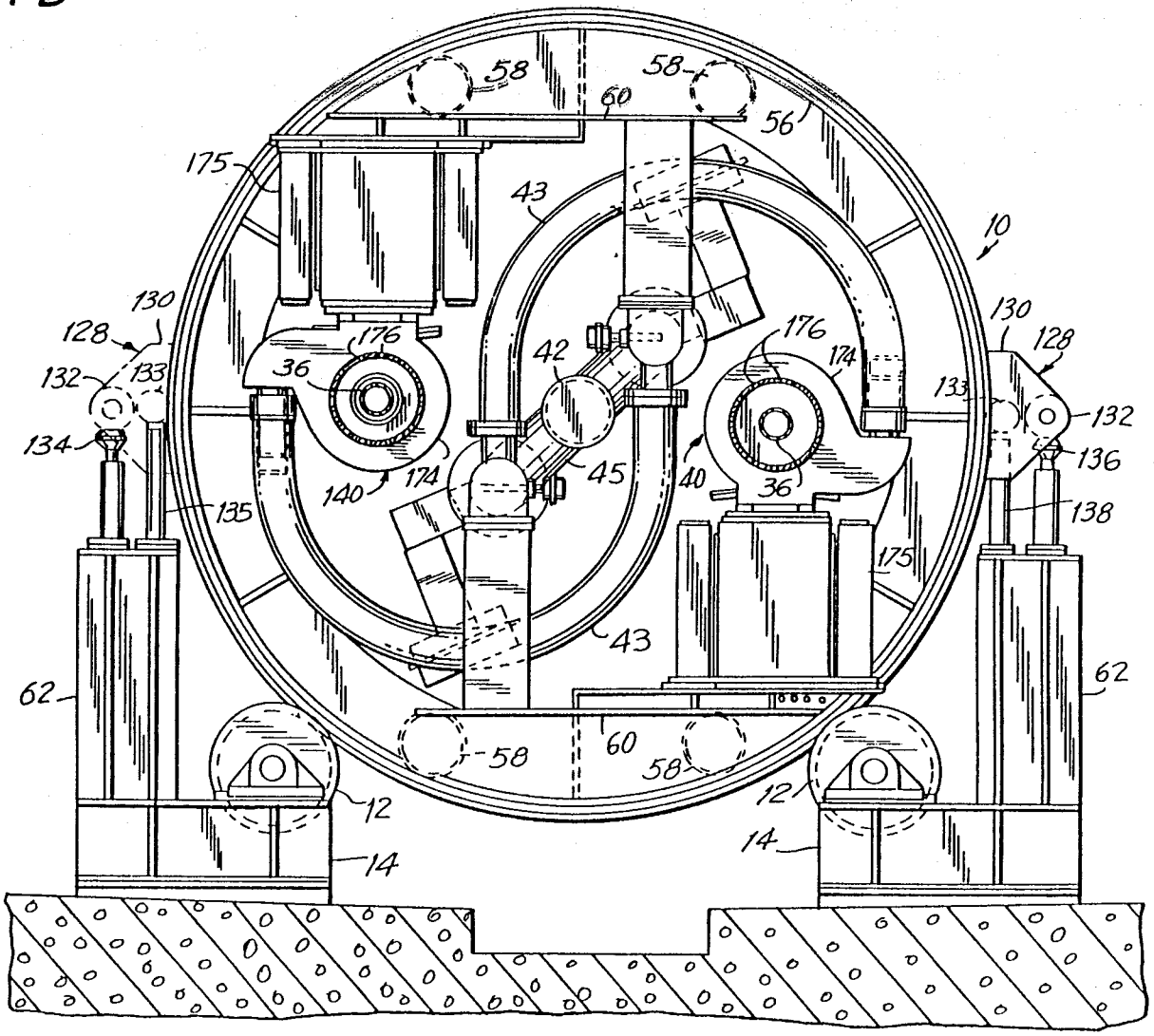

FIG. 7*b* is an enlarged cross-sectional view taken along lines 7B—7B of FIG. 1 showing, in more detail, the outside quenching head assemblies.

Figure 8:
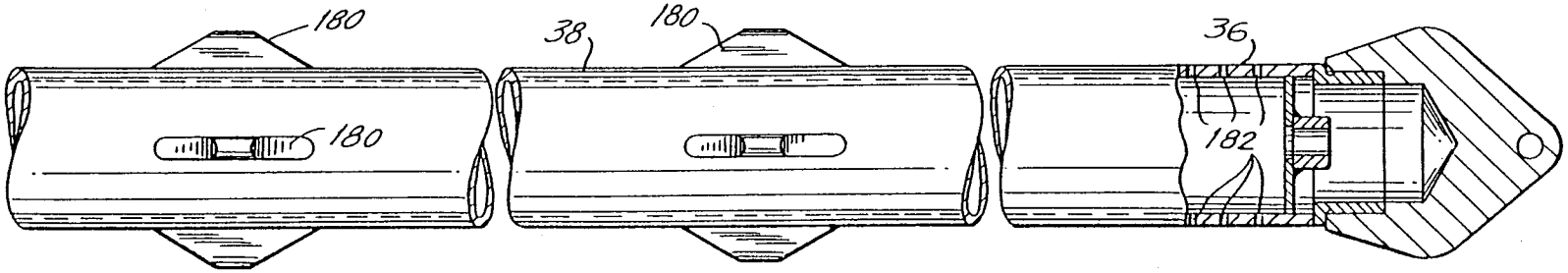

FIG. 8 is a fragmentary enlarged view of one of the mandrel and inside quenching head assemblies.

DETAILED DESCRIPTION OF THE INVENTION

Figure 1A:
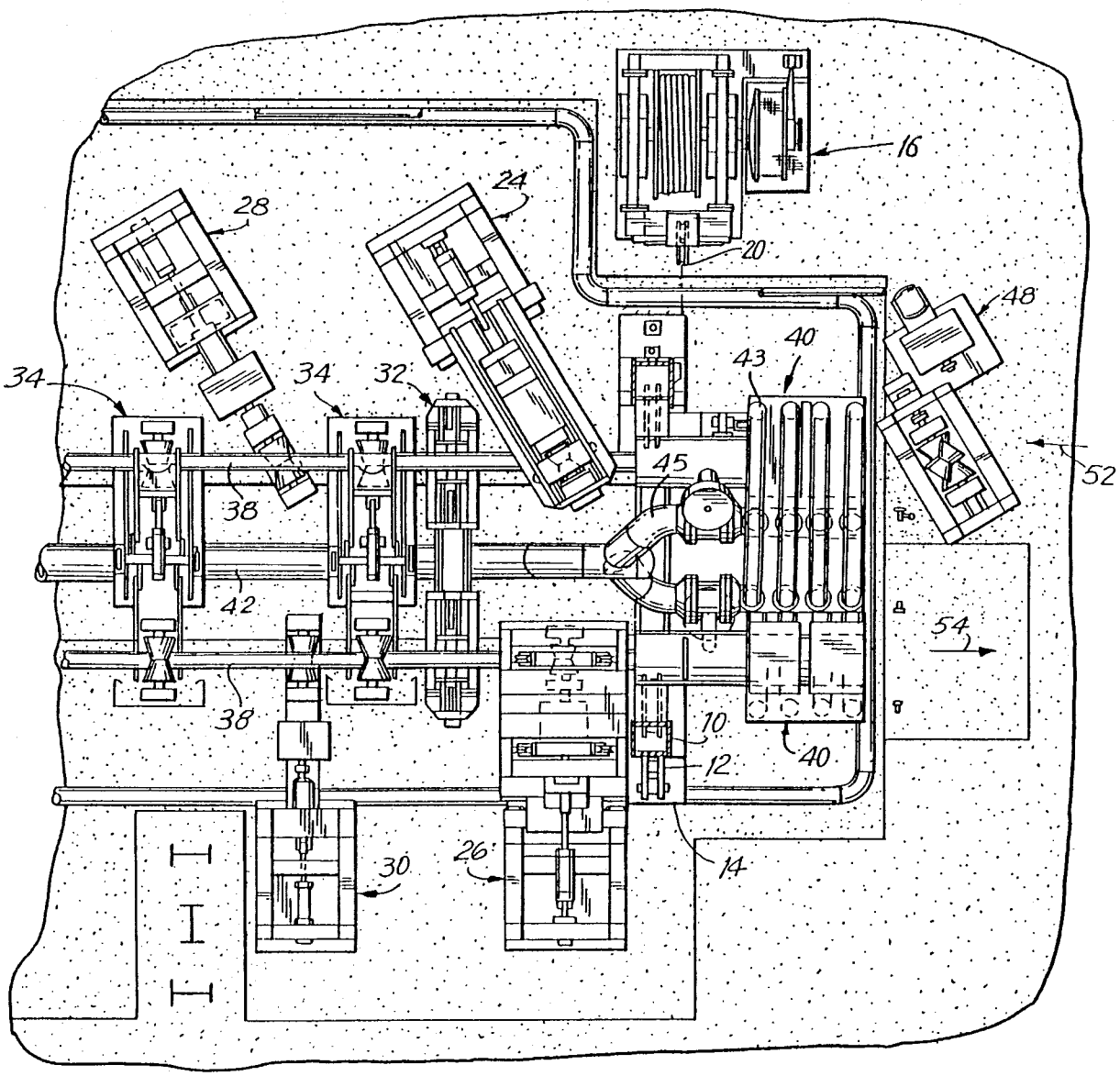
FIG. 1A is an enlarged fragmentary top view of the apparatus showing, in greater detail, certain of the quenching heads, clamps, and conveyors shown in FIG. 1.
Figure 2:
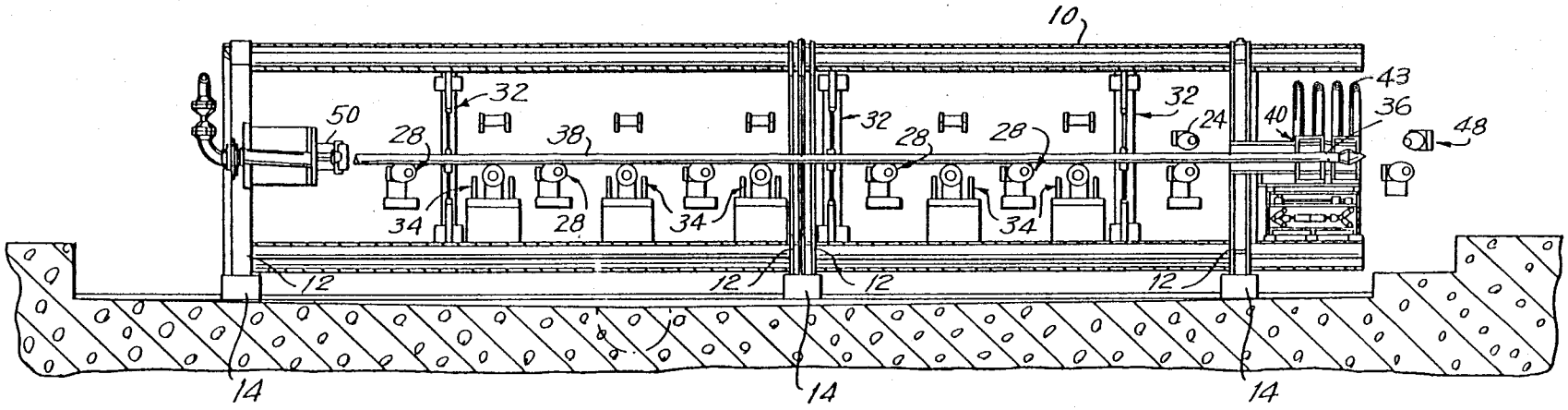
FIG. 2 is a diagrammatic elevational view of the apparatus shown in FIG. 1 showing the quenching side and related guide rolls, quench conveyors, and clamps.

Referring first to FIGS. 1, 1A, and 2, the apparatus of the present invention comprises a generally cylindrical oscillatable frame 10 mounted for rotation on rollers 12 supported by the foundation 14. The frame 10 may be oscillated through an angle of 180° about the longitudinal axis of the apparatus by winch mechanisms 16, 18 through drive cables 20, 22. The winch mechanisms 16, 18 are mounted on the foundation 14.

Figure 3A:
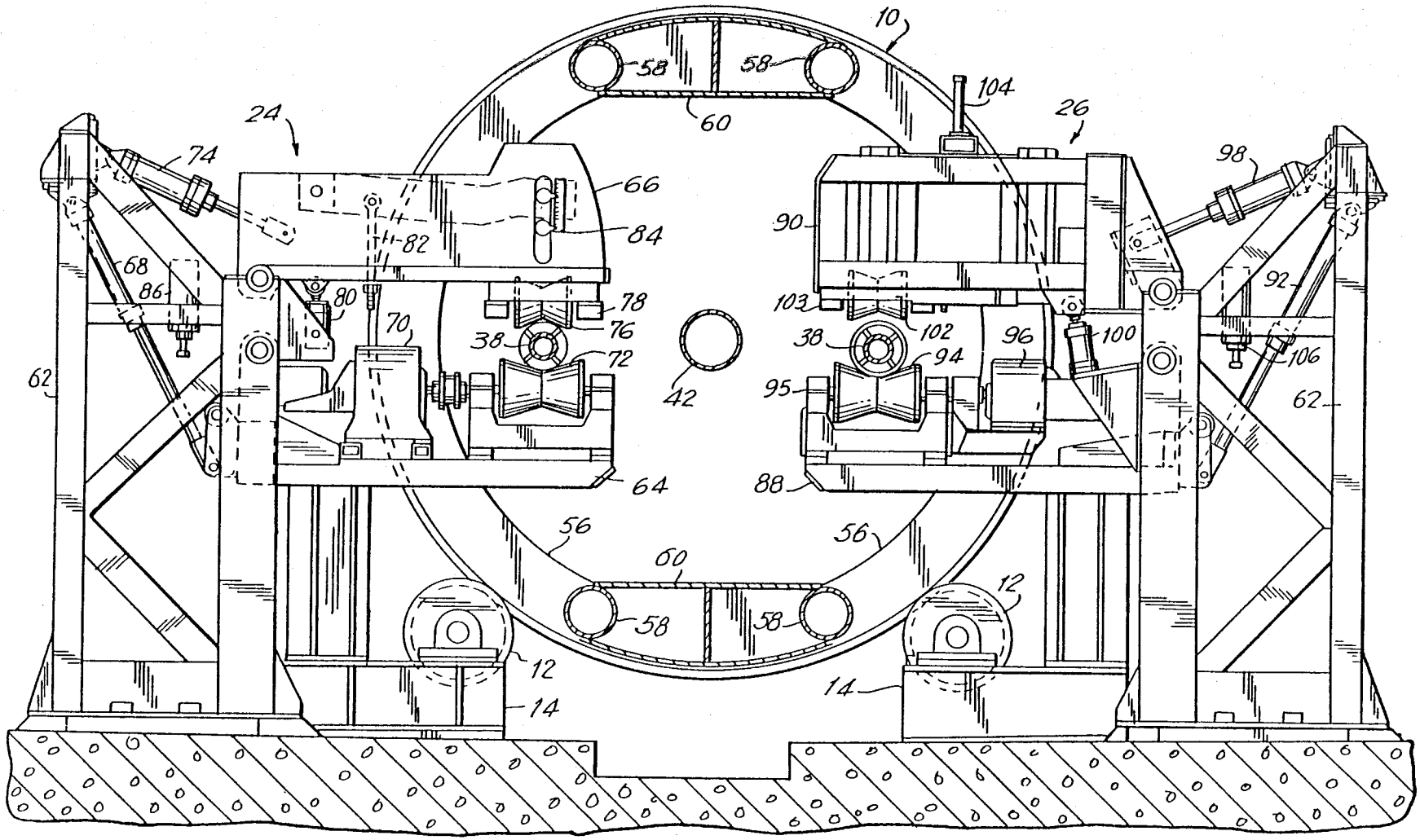
FIG. 3A is a vertical cross-sectional view taken along lines 3A—3A of FIG. 1 showing the guide roll and pinch roll assemblies in their respective engaged positions.
Figure 3B:
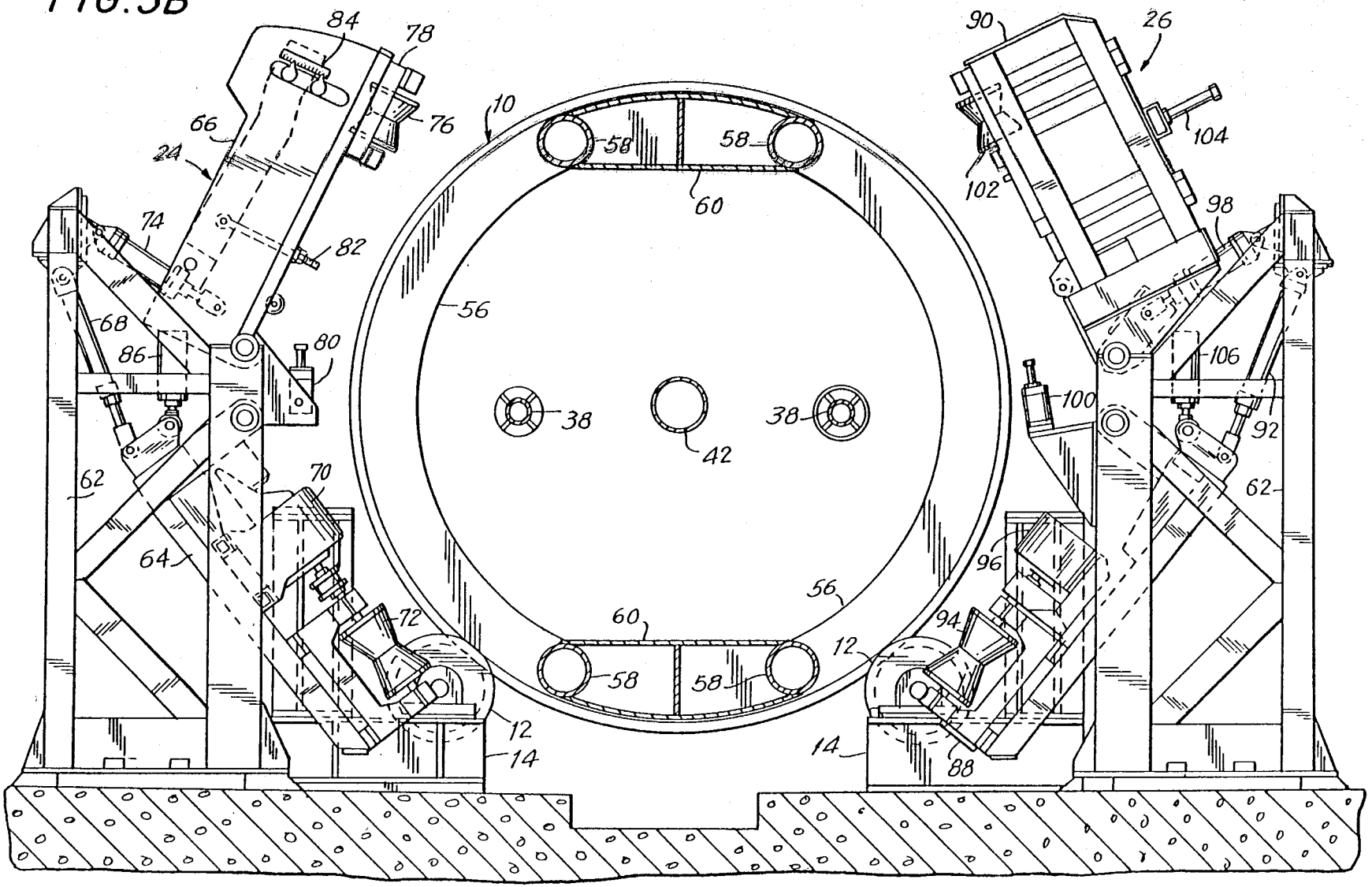
FIG. 3B is a vertical cross-sectional view of the guide roll and pinch roll assemblies of FIG. 3A in their respective retracted positions.
Figure 4A:
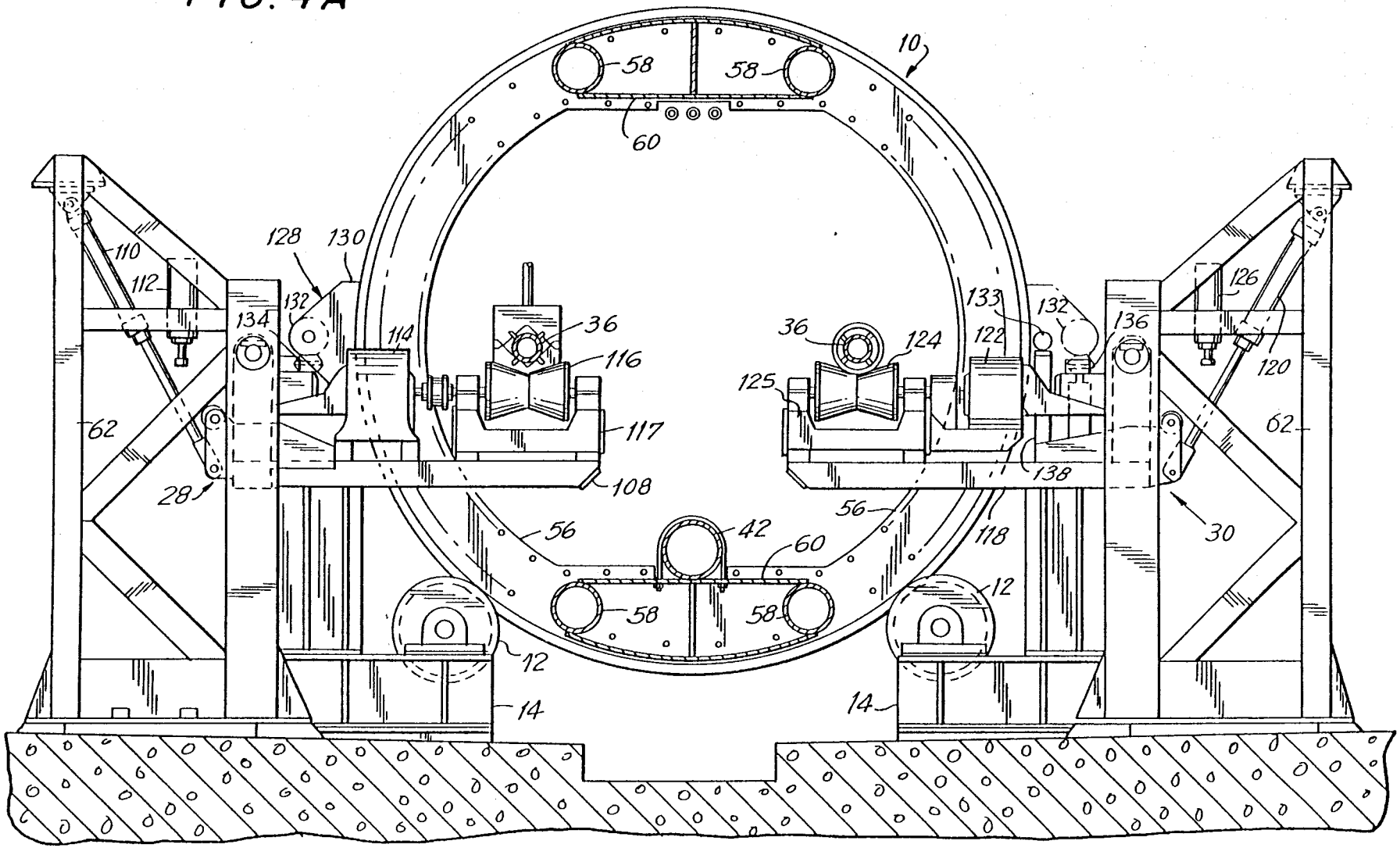
FIG. 4A is a vertical cross-sectional view taken along lines 4A—4A of FIG. 1 showing the conveyor rolls in the support position.
Figure 4B:
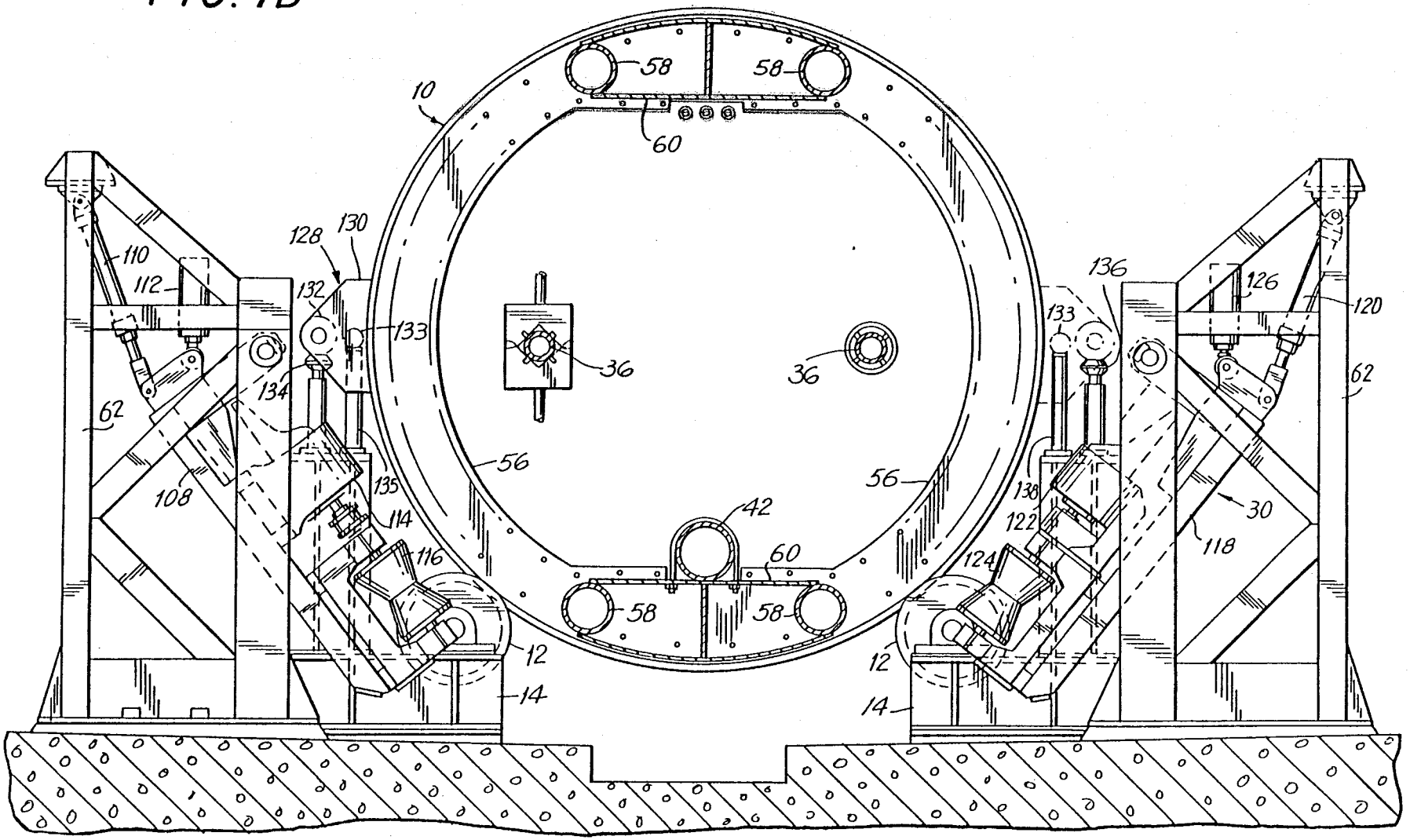
FIG. 4B is a vertical cross-sectional view of the conveyor rolls shown in FIG. 4A but in the retracted position.

The apparatus includes a guide roll assembly 24, and a pinch roll assembly 26 shown in more detail in FIGS. 3A and 3B; a series of quench conveyor assemblies 28 and unload conveyor assemblies 30 shown in more detail in FIGS. 4A and 4B. The apparatus also includes a series of pipe clamp assemblies 32 shown in more detail in FIG. 5 and a series of tube clamp assemblies 34 shown in more detail in FIG. 6.

The inside quench heads 36 (see FIG. 8) are mounted on mandrels 38 disposed parallel to the axis of the frame 10 and located within the outside quench head assemblies 40. The outside quench assemblies 40 are shown in more detail in FIGS. 7A and 7B and are located at the entry end of the apparatus shown at the right end of FIG. 1. Water for the outside quench heads 40 is delivered through the water supply system 46, the main 42 disposed parallel to the axis of the frame 10, distributors 45, and flexible hoses 43, while water for the inside quench heads 36 is delivered through the mandrels 38 and feeders 44 from the water supply system 46.

The principal components of the apparatus also include water cooled entry guide rolls 48 and a tube stop assembly 50.

Before describing in further detail the various assemblies and components referred to above, it will be helpful to outline the overall operation of apparatus in reference to FIG. 1. A tubular heated in an adjacent furnace (not shown) enters the apparatus at the point and in the direction indicated by arrow 52 at the top right of the drawing where it is engaged by the entry guide rolls 48 which are skewed so as to drive and rotate the tubular. The tubular is first directed through the inside and outside quenching heads 36, 40 and over the mandrel 38 which carries the inside quenching head 36. Thereafter, the tubular is engaged by the guide roll assembly 24 and, sequentially, by the several quench conveyor assemblies 28. When the tubular engages the tube stop assembly 50, the conveyors and guides stop, the tube clamp assemblies 34 engage the tubular, the conveyor assemblies 28, 30, guide roll assembly 24, and pinch roll assembly 26 are retracted and the frame 10 is oscillated through 180°. Thereafter, the conveyor assemblies 28, 30 are returned to the support position and the quenched tubular is withdrawn or unloaded from the apparatus in the direction of the arrow 54 while a second heated tubular is being quenched in the apparatus. Following the unloading of the first tubular and the quenching of the second tubular, the clamps 32 are engaged, the conveyors 28, 30 and the guide and pinch rolls 24, 26 are retracted and the frame is rotated back to its original position. Thereafter, the cycle of operations is repeated.

Guide Rolls and Pinch Rolls

Reference is now made to FIGS. 3A and 3B which show in more detail the water cooled guide rolls 24 on the entry side of the apparatus and the pinch rolls 26 on the exit side of the apparatus. In this view the cylindrical form of the frame 10 and its mounting on the rollers 12 is clearly shown. The frame 10 may conveniently be formed from circular segments 56 welded to tubulars 58 and reinforced by longitudinal plates 60.

Symmetrically disposed on each longitudinal side of the cylindrical frame 10 is a support frame 62 formed from structural steel members and adapted to carry the guide rolls 24, the quench conveyors 28, the unload conveyors 30 and the pinch rolls 26.

The guide rolls 24 comprise a pivotally mounted lower jaw member 64 and a pivotally mounted upper jaw member 66. The position of the lower jaw member 64 is controlled by an hydraulic cylinder 68. Mounted on the lower jaw member 64 is a variable speed drive motor 70 and a direct driven vee-roller 72. As shown in FIGS. 1 and 1A, the guide rolls 24 are mounted at an acute angle to the line of motion of the tubulars through the apparatus so as to induce a combination of motion comprising rotation and translation to a tubular as it passes through the quenching portion of the apparatus.

The upper jaw 66 of the guide rolls 24 is pivotally mounted on the frame 62 and its position controlled by an hydraulic cylinder 74. A vee-shaped guide roller 76 is freely journalled on an adjustable mounting 78 affixed to the upper jaw 66 and adapted to accommodate a range of tubulars. When engaged, the upper jaw member 66 strikes the shock absorber 80. The upper jaw 66 may be adjusted by the threaded link 82 in conjunction with a scale 84 calibrated to indicate the diameter of the various tubulars to be processed by the apparatus.

As shown in FIG. 3B, the upper jaw 66 and the lower jaw 64 may be pivoted so as to be clear of the frame 10 by actuation of both hydraulic cylinders 68 and 74. In the retracted position the lower jaw strikes the shock absorber 86.

FIGS. 3A and 3B also show the pinch roll assembly 26 on the unload side of the apparatus. The pinch rolls 26 are similar in construction to the guide rolls 24 but are mounted normal to the path of movement of the tubular through the apparatus since it is unnecessary to impart a rotating motion to the tubular after it has been quenched. The pinch rolls 26 comprise a pivotally mounted lower jaw 88 and a pivotally mounted upper jaw 90. The position of the lower jaw is controlled by an hydraulic cylinder 92 mounted between the lower jaw 88 and the support frame 62. A pinch rolls vee-roller 94 is freely journalled on a mounting 95 affixed to the lower jaw 88 and driven by a pinch roll motor 96 also mounted on the lower jaw 88.

The position of the upper jaw 90 of the pinch roll 26 is controlled by an hydraulic cylinder 98. In the engaged position, the upper jaw strikes the shock absorber 100. A vee-roller 102 is freely journalled in a mounting 103 adjustably mounted in the upper jaw 90. The vertical position of the vee-roller 102 and mounting 103 relative to the upper jaw 90 may be controlled by the mechanism 104, which resiliently loads the upper vee-roller 102 and mounting 103 so as to provide the desired pinch pressure required to drive the tubular out of the apparatus. As shown in FIG. 3B, when the upper and lower pinch roll jaws 90 and 88 are retracted, the pinch rolls 26 are free from the frame 10 which may then be oscillated to the desired position. In the retracted position, the lower pinch roll jaw 88 strikes a shock absorber 106.

Quench and Guide Conveyors

As shown in FIG. 1, there are a series of five quench conveyors 28 on the quench side of the apparatus and five guide conveyors 30 on the unloading side of the apparatus. These conveyors are shown in more detail in FIGS. 4A and 4B. As in the case of the guide rolls 24 and pinch rolls 26, the quench conveyors are positioned at an acute angle to the line of motion of the tubular through the apparatus so as to impart a rotary motion to the tubular during the quenching operation. The guide conveyors 30 are located normal to the line of motion of the tubular since it is unnecessary to rotate the quenched tubular during the unloading sequence.

Referring now to FIG. 4A, the quench side of the apparatus is shown at the left while the unloading side is shown at the right. The quench conveyor 28 comprises a jaw 108 which is pivotally mounted on the support frame 62. The jaw 108 is controlled by an hydraulic cylinder 110. In its retracted position as shown in FIG. 4B, the jaw 108 strikes a shock aborber 112. A quench conveyor variable speed drive motor 114 is mounted on the jaw 108 and drives a quench conveyor vee-roller 116 freely journalled in a mounting 117. The quenched tubular is conveyed over the vee-roller 116. The unloading conveyor 30 comprises a pivotally mounted jaw 118 whose position is controlled by an hydraulic cylinder 120 mounted between the support frame 62 and the jaw 118. An unloading conveyor drive motor 122 is mounted on the jaw 118 and drives a vee-roller 124 freely journalled in a mounting 125 which is affixed to the jaw 118. In its retracted position, the jaw 118 strikes a shock absorber 126 mounted on the support frame 62. As in the case of the guide rolls 24 and the pinch rolls 26, when the jaws of the quench conveyors 28 and the unloading conveyors 30 are in the retracted position, the frame 10 may be oscillated between its extreme positions.

FIGS. 4A and 4B also show one of the three sets of stop mechanisms 128 by which the oscillating motion of the frame 10 is limited. The stops are located at each end of the frame 10 and in the central region of the frame 10. The stop 128 comprises a bracket 130 welded to the frame 10, a roller 132 and a stop 133 affixed to the bracket 130 which, respectively, are adapted to strike against a shock absorber 134 and a stop 135, both mounted on the support frame 62. The stop 128 is shown in solid lines at the left side of FIGS. 4A and 4B and in phantom lines at the right side of FIGS. 4A and 4B, where it strikes a second shock absorber 136 and stop 138, both mounted on the support frame 62 to define the extreme rotated position of the frame 10.

Figure 5:
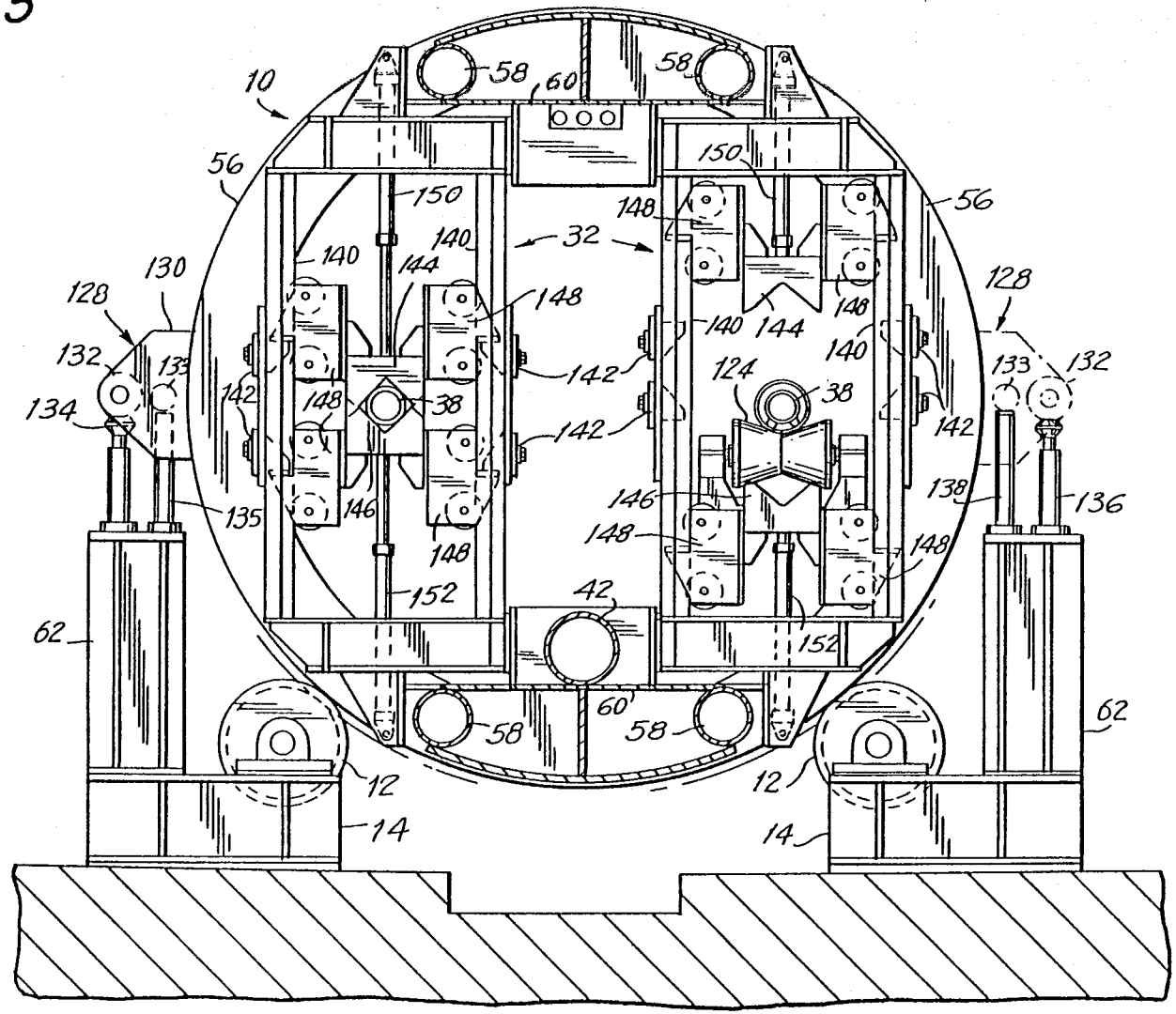
FIG. 5 is a vertical cross-sectional view taken along lines 5—5 of FIG. 1 showing, on the left, the pipe clamps in the engaged position and, on the right, the pipe clamps in the disengaged position.

FIG. 5 illustrates the pipe clamps 32 mounted within the frame 10. The clamp 32 on the quench side of the apparatus is shown in the closed or clamped position while the clamp 32 on the unloading side of the apparatus is shown in the open or unclamped position. Each pipe clamp 32 comprises a pair of vertically disposed guide channels 140 affixed to the frame 10. A pair of adjustable clamp stops 142 is mounted on each guide channel 140 to define the clamped position of the pipe clamps. Each clamp 32 also comprises an upper clamp face 144 and a lower clamp face 146 disposed between roller members 148 which are adapted to roll on the guide channels 140 and engage the stops 142. The position of the upper clamp face 144 is controlled by an hydraulic cylinder 150 mounted between the frame 10 and the upper clamp face 144. Similarly, the position of the lower clamp face 146 is controlled by an hydraulic cylinder 152 mounted between the frame 10 and the lower clamp face 146.

As shown in FIG. 1, there are three sets of pipe clamps 32 disposed along the length of the apparatus. The pipe clamps are adapted to engage the mandrels 38 which carry the inside quench heads 36 and maintain the mandrels 38 in proper registry whenever the mandrels 38 are not supported by a tubular. Thus, the pipe clamps 32 are sequentially opened as a tubular enters the quench side of the apparatus and sequentially closed as a tubular is unloaded from the apparatus. FIG. 5 also shows the stop mechanisms 128 for the oscillatable frame 10 and, on the right, vee-roller 124 of an adjacent unloading conveyor 30.

Figure 6:
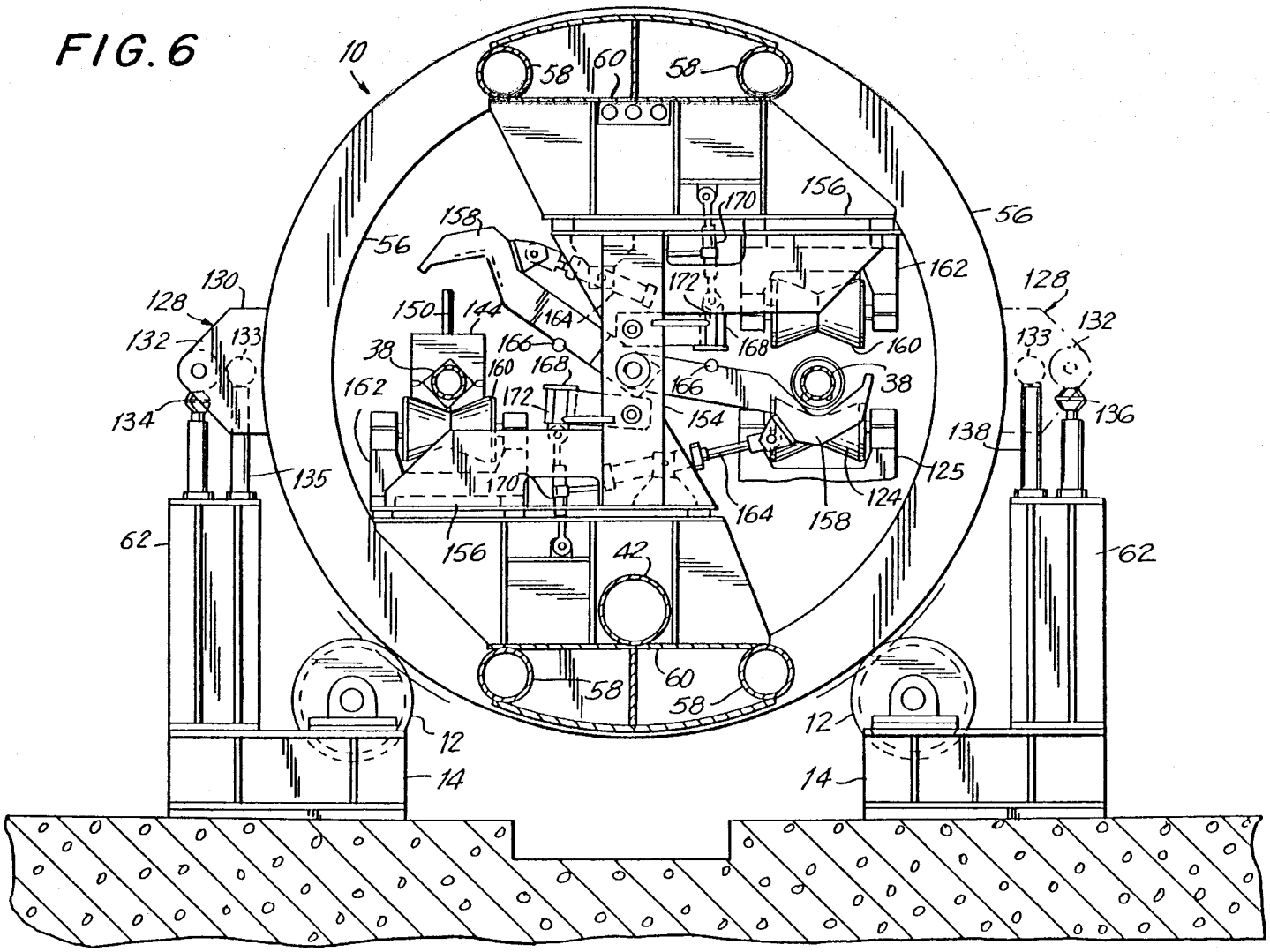
FIG. 6 is a vertical cross-sectional view taken along lines 6—6 of FIG. 1 showing on the left the tube clamps in the open position and, on the right, the tube clamps in the closed position.

FIG. 6 illustrates one of the five tubular clamps 34 which are disposed along the length of the apparatus as shown in FIG. 1. Referring to FIG. 6, the tubular clamps 34 are mounted within the frame 10 and comprise a central vertical column 154 affixed at each end to the frame 10. The central column 154 carries a pair of fixed jaw members 156 and a pair of pivotally mounted jaw members 158. Each fixed jaw member 156 carries a vee-roller 160 freely journalled in a mounting 162. The position of the pivotally mounted jaw members 158 are controlled by hydraulic cylinders 164 mounted between the vertical column 154 and the jaw members 158. Each jaw member 158 is provided with a stop 166 which contacts an adjustable stop 168, the position of which is controlled by an hydraulic cylinder 170 mounted between the vertical column 154 and the adjustable stop 168. The adjustable stop 168 is provided with a scale 172 calibrated to indicate the size of the tubular being processed by the apparatus.

It will be understood that the tubular clamps 34 will be maintained in the open position on the quench side of the apparatus as the tubular is being quenched. Thereafter, and prior to rotation of the frame 10, the quench side tubular clamps 34 are closed and the frame 10 is rotated to bring the tubular to the unloading side of the apparatus. Prior to the commencement of the unloading sequence, the tubular clamps 34 are opened to permit longitudinal motion of the tubular along the several unload conveyors 30.

FIGS. 7A and 7B are, respectively, elevational and cross-sectional views of the outside quench assemblies 40. These assemblies comprise a manifold 174 fed by a plurality of flexible hoses 43 which communicate with the distributors 45 and the water main 42. The inner surface of the manifold 174 is cylindrical and coaxial with the mandrels 38 and is provided with a large number of orifices 175 angled away from the entry end of the apparatus.

The inside diameter of the manifold 174 may vary from about $14\frac{1}{2}$ inches for tubulars in the diameter range of $4\frac{1}{2}$ to 7 inches to about $17\frac{5}{8}$ inches for tubulars in the diameter range of $7\frac{5}{8}$ to 9.82 inches to about $20\frac{3}{4}$ inches for tubulars in the diameter range of $10\frac{3}{4}$ to $13\frac{3}{8}$ inches. In each case, the orifices 175 are preferably 5/32 inch in diameter and located on 2-inch centers along the length of the manifold 174. The lines of orifices 176 may be spaced about 1.3 to 1.5 inches apart and alternately offset so that each orifice 175 is substantially equidistant from all adjacent orifices 175. Depending on the diameter of the manifold 174, the total number of orifices 175 may vary from about 525 to 805. As each outside quench head 40 comprises two manifolds 174 in axial alignment, the total number of orifices varies between about 1050 and 1610. Preferably, the orifices 175 are disposed at an angle of about 30° to the axis of the manifold 174 and are aimed away from the entry end of the apparatus, i.e., in the direction of the motion of the tubular as it is being quenched.

The manifolds 174 are mounted on a lift table 176, the position of which may be adjusted by an hydraulic lift mechanism 178 so as to assure that the quench manifolds 174 are properly aligned with the tubular being processed. FIG. 7B also shows the stop mechanisms 128 which define the limits of rotation of the frame 10.

FIG. 8 shows a fragmentary view of one of the mandrels 38 and the inside quench head 36 welded to the free end of the mandrel 38. A series of skids 180 are welded to the mandrel 38 at spaced intervals along its length. The outer diameter of the mandrel at the location of the skids is somewhat smaller than the inside diameter of the tubular to be processed so that the mandrel is guided through the tubular substantially along the axis of the tubular. Depending upon the size of the tubular to be processed, the length of the inside quench section 36 containing a plurality of holes 182 may vary from about 4 feet to about 6 feet. The holes, which may vary in diameter from about ⅛ inch to about 5/32 inch, are preferably spaced on 1 inch centers in the longitudinal direction and between about 0.916 and 1.02 inch in the circumferential direction. Preferably, the lines of holes 182 are alternately offset so that each hole 182 is substantially equidistant from all adjacent holes 182. Depending upon the size of the tubular being processed, the inside quench head may have between about 570 and 1200 holes. It is desirable to provide a water pressure at the quench heads in the range of 30 to about 100 psi in order to obtain rapid quenching of the tubular.

Operation

The operation of the apparatus is as follows. Steel tubulars are heated in an appropriate furnace disposed adjacent to the entry end of the apparatus generally to a uniform temperature above about 1550° F. in order to attain an austenitic structure in the steel. At the beginning of the operation, the pipe clamp assemblies 32 are engaged with the mandrels 38 so as to locate the mandrels on the axis of the travel of the tubular; the guide rolls 24, the quench conveyors 28 are in the engaged positions and the tube clamps 34 are open. In addition, the conveyor motors are operating and the quenching water is flowing. The tubular is then withdrawn from the furnace, engaged by the entry rolls 48 and driven between the inside quench head 36 and the outside quench head 40. The tubular is then engaged and driven by the guide rolls 24. As the tubular approaches the first pipe clamp 32, that clamp is opened to release the mandrel 38 and permit the tubular to continue to move onto the mandrel. The tubular then successively engages the first and second quench conveyors 28. As the tubular approaches the second pipe clamp 32, that clamp also opens and the tubular successively engages the third and fourth quench conveyors 28. Thereafter, the third pipe clamp 32 opens and the tubular continues its advance, engaging the fifth and last quench conveyor 28. The tubular then strikes the stop 50 and comes to rest, its trailing end having now cleared the quench heads 36 and 40. When the tubular strikes the stop 50, the guide rolls 24 and conveyors 28 stop, the tube clamp assemblies 34 are closed, and the guide roll and quench conveyor jaws are moved to the retracted position, thereby permitting the frame 10 to be rotated 180° in a counterclockwise direction as viewed from the entry end of the apparatus so as to position the tubular on the unload side of the apparatus. The unload conveyors 30 are then moved to the engaged position, the tube clamps 34 opened, and the unload conveyors 30 driven so as to unload the tubular in the direction of the arrow 54 (FIG. 1). As the tubular passes each pipe clamp 32, that clamp closes so as to hold the mandrel 38 in place.

It will be understood that as soon as the tubular is positioned on the unload side of the apparatus, a second heated tubular may be processed through the quench heads following the same sequence as set forth above. When the second tubular has come to rest against the stop and the conveyors are retracted and the tube clamps engaged, the frame 10 is again rotated 180°, but this time the direction is clockwise so that after two cycles the apparatus has returned to its original position.

It is desirable to quench the tubulars from above about 1550° F. to about 700° F. in a time interval of about 0.5 second in order to obtain a substantially martensitic structure in the quenched steel. This can be accomplished with a tubular speed of about 40 feet per minute in the apparatus of the present invention. As the tubulars are nominally 48 to 50 feet long, the quenching operation can be conducted in about one minute. An additional minute, or less, is required to retract the conveyors, rotate the frame 10, and re-engage the conveyors. Thus, the apparatus is able to quench about 30 to 40 tubulars per hour or about 300 tubulars per turn.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. Apparatus for simultaneously quenching the inside and outside surfaces of a tubular having leading and trailing ends comprising substantially cylindrical frame means oscillatible about its axis through an angle of 180° from a first position to a second position, driving means connected with said frame means and adapted to oscillate said frame means between said first and second positions, at least one mandrel means eccentrically located within said frame means and having mounted on one end thereof inside quench head means, at least one outside quench head means mounted on said frame means coaxially with said inside quench head means; first clamping means mounted on said frame means adapted to releaseably clamp said mandrel means to said frame means, quenching water supply means communicating with said mandrel means and said outside quench head means, retractable guide roll means located adjacent said outside quench head means adapted to quide and convey said tubular past said inside quench head means and said outside quench head means, first retractable conveying means located to engage and convey said tubular over said mandrel means when said frame means is in its first position, second clamping means mounted on said frame means adapted to releaseably clamp said tubular to said frame means, stop means adapted to contact the leading end of said tubular when the trailing end of said tubular has passed over said inside quench head means and second retractable conveying means located along said mandrel means and adapted to engage and convey said tubular over said mandrel means when said frame means is in its second position.

2. Apparatus as set forth in claim 1 comprising two mandrel means, each having inside quench head means located at one end thereof, and two outside quench head means.

3. Apparatus as set forth in claim 1, wherein said first retractable conveying means comprise a plurality of individual conveyors spaced along said mandrel when said frame means is in its first position.

4. Apparatus as set forth in claim 3, wherein said second retractable conveying means comprise a plurality of individual conveyors spaced along said mandrel when said frame means is in its second position.

5. Apparatus as set forth in claim 1, wherein said first clamping means comprise a plurality of individual clamping means spaced along said frame means.

6. Apparatus as set forth in claim 5, wherein said second clamping means comprise a plurality of individual clamping means spaced along said frame means.

7. Apparatus as set forth in claim 2, wherein said first retractable conveying means comprise a plurality of individual conveyors spaced along one of said mandrels, said second retractable conveying means comprise a plurality of individual conveyors spaced along the other of said mandrels, said first clamping means comprise a plurality of individual clamping means spaced along said frame means and said second clamping means comprise a plurality of individual clamping means spaced along said frame means.

* * * * *